US009388536B2

(12) United States Patent
De Vries

(10) Patent No.: US 9,388,536 B2
(45) Date of Patent: Jul. 12, 2016

(54) METHOD FOR FORMING AN ARTIFICIAL GRASS LAYER AND ARTIFICIAL GRASS PRODUCT FOR USE THEREIN

(75) Inventor: Hugo De Vries, Ridderkerk (NL)

(73) Assignee: Greenfields B.V., Genemuiden (NL)

( * ) Notice: Subject to any disclaimer, the term of this patent is extended or adjusted under 35 U.S.C. 154(b) by 1243 days.

(21) Appl. No.: 13/513,514

(22) PCT Filed: Apr. 15, 2010

(86) PCT No.: PCT/NL2010/050195
§ 371 (c)(1),
(2), (4) Date: Aug. 2, 2012

(87) PCT Pub. No.: WO2010/120175
PCT Pub. Date: Oct. 21, 2010

(65) Prior Publication Data

US 2012/0301637 A1 Nov. 29, 2012

(30) Foreign Application Priority Data

Apr. 15, 2009 (NL) ..... 1036854

(51) Int. Cl.
*E01C 13/08* (2006.01)
*D03D 1/00* (2006.01)
(Continued)

(52) U.S. Cl.
CPC *E01C 13/08* (2013.01); *D03D 1/00* (2013.01); *D03D 9/00* (2013.01); *D04H 11/00* (2013.01);
(Continued)

(58) Field of Classification Search
CPC ..... E01C 13/08; D10B 2505/202; Y10T 428/239121; Y10T 428/23957; B32B 37/14; B32B 37/146; D04H 11/00; D03D 1/00; D03D 9/00
USPC ..... 428/92, 87; 156/72
See application file for complete search history.

(56) References Cited

U.S. PATENT DOCUMENTS 3,673,056 A 6/1972 Nadler
4,138,514 A 2/1979 Terpay
(Continued)

FOREIGN PATENT DOCUMENTS

GB 2185769 A 7/1987
JP 2091302 A 3/1990
(Continued)

*Primary Examiner* — Cheryl Juska
(74) *Attorney, Agent, or Firm* — Bret E. Field; Bozicevic, Field & Francis LLP

(57) ABSTRACT

The invention relates to a method for forming an artificial grass layer on a substrate, comprising the steps of supplying a pack of flat and deformable artificial grass strips, in which the strips are arranged with their flat faces side-by-side and are connected to each other at mutually offset locations, placing the pack of artificial grass strips on or partially in the substrate, pulling apart the artificial grass strips, thus forming a grid, and at least partially filling at least some of the openings in the grid with a stabilizing material. The invention further relates to a method for forming such a pack of flat and deformable artificial grass strips. And finally, the invention relates to an artificial grass product, comprising a pack of flat and deformable artificial grass strips, each strip comprising a substantially straight lower edge and an upper edge having artificial grass blades protruding therefrom, wherein the strips are arranged with their flat faces in side-by-side relationship and their straight lower edges in substantially the same plane, and are connected to each other at mutually offset locations.

25 Claims, 3 Drawing Sheets

Figure 1:
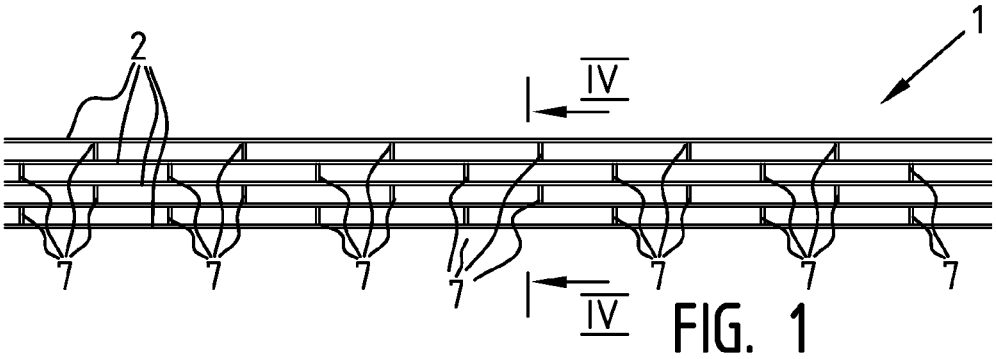

(51) Int. Cl.
*D03D 9/00* (2006.01)
*D04H 11/00* (2006.01)

(52) U.S. Cl.
CPC ..... *D10B 2505/202* (2013.01); *E01C 2013/086* (2013.01); *Y10T 428/23921* (2015.04); *Y10T 428/23957* (2015.04)

(56) References Cited

U.S. PATENT DOCUMENTS 4,804,293 A * 2/1989 Varkonyi et al. ..... 405/15
5,449,543 A * 9/1995 Bach et al. ..... 428/117
5,927,906 A * 7/1999 Bach et al. ..... 405/302.6
6,296,924 B1 * 10/2001 Bach ..... 428/137
6,395,372 B1 * 5/2002 Bach ..... 428/137
2010/0104367 A1 * 4/2010 Shim et al. ..... 405/16
2014/0147218 A1 * 5/2014 De Vries ..... 405/302.6

FOREIGN PATENT DOCUMENTS

JP 2167747 A 6/1990
JP 2261104 A 10/1990
WO WO 9535417 A1 * 12/1995
WO WO 2011125044 A2 * 10/2011

* cited by examiner

METHOD FOR FORMING AN ARTIFICIAL GRASS LAYER AND ARTIFICIAL GRASS PRODUCT FOR USE THEREIN

The invention relates to a method for forming an artificial grass layer on a substrate.

Artificial grass is generally known. It is not only used for laying sports fields, but also increasingly in gardens and public green areas. In comparison with natural grass the advantage of artificial grass is that it requires little or no maintenance and yet remains fresh all year long.

Until now, artificial grass is usually laid by preparing a substrate and then unrolling an artificial grass mat thereon. This artificial grass mat is manufactured in a factory using techniques that are derived from the carpeting industry. The artificial grass mat usually has a backing that is formed by a fabric or non-woven, and on which a large number of upright piles forming the blades of the artificial grass are attached by tufting, weaving or any other connection technique. Apart from the fact that the artificial grass mat is of course supported by the substrate, there is no functional interaction between the artificial grass mat and the substrate.

The invention now has for its object to provide an improved method for laying artificial grass by which the artificial grass may enter into functional interaction with the substrate, for instance serving to stabilize the substrate. In accordance with the invention this is accomplished by a method comprising the steps of supplying a pack of flat and deformable artificial grass strips, in which the strips are arranged with their flat faces side-by-side and are connected to each other at mutually offset locations, placing the pack of artificial grass strips on or partially in the substrate, pulling apart the artificial grass strips, thus forming a grid, and at least partially filling at least some of the openings in the grid with a stabilizing material. The connection locations form fixed points or vertices in the grid.

By laying the artificial grass in the form of a grid that can partially be accommodated in the substrate and by subsequently stabilizing the grid with filling material, the artificial grass may be used to support the substrate. For instance a substrate of relatively loose material like desert sand may be stabilized in this way, so that it may carry loads and may for instance be used as a road. Moreover, the artificial grass immediately gives the surroundings a covered or overgrown appearance. Since the artificial grass is supplied in the form of a pack of strips that may simply be pulled apart concertina-like, it may swiftly be laid. The artificial grass may also be used for instance on a sloping substrate, like a road bank, to secure this substrate against shifting. Use next to a road as material for reinforcing a shoulder is also conceivable, while the artificial grass may of course also simply be used as a sports field or a playground.

It should be noted that the term "artificial grass" as used herein covers not just imitation grass made of plastics material, but each kind of imitation grass that does not naturally grow in the substrate, also when the artificial grass strips are made of natural fiber material.

The invention further relates to a method for forming a pack of flat and deformable artificial grass strips which may be used in the above described method for laying an artificial turf.

The method according to the invention comprises the steps of forming a plurality of flat artificial grass strips, each comprising a substantially straight lower edge and an upper edge having artificial grass blades protruding therefrom, placing the artificial grass strips with their flat faces in side-by-side relationship, such that the straight lower edges of the strips lie substantially in the same plane, and connecting adjacent artificial grass strips to each other at mutually offset locations.

The flat artificial grass strips may be formed at a large scale in simple manner by forming a flat cloth and cutting the lengths of cloth therefrom. When forming the flat cloth, relatively dense lengths of cloth may then be formed, which are connected by relatively wider spaced synthetic fibers, and repeatedly a relatively dense length of cloth and a plurality of relatively wider spaced synthetic fibers may be cut from the cloth to form an artificial grass strip. In this way a repeating pattern of dense lengths of cloth and intermediate fibers, which each time define an artificial grass strip, may be formed in the cloth.

When the relatively widely spaced synthetic fibers are cut at various distances from the relatively dense length of cloth, artificial grass blades having various lengths are formed, which give the artificial grass a natural appearance.

Preferably the flat cloth is woven, wherein the relatively dense lengths of cloth run in warp direction and the relatively widely spaced synthetic fibers run in weft direction. In this way the cloth may be manufactured at industrial and at relatively low cost, while the selected orientations of the dense length of cloth and the intermediate fibers allow the design of the artificial grass strips to be adapted to the requirements in a simple manner.

When the mutual spacing of the relatively widely spaced artificial fibers is varied, wisps of artificial grass are formed, which provide an even more natural appearance. This can be achieved by varying the mutual spacing of the weft threads during weaving, but also by using different materials for the weft threads, like for instance a fibrous material having a high amount of shrinkage or a biodegradable fiber material.

On the other hand it is also conceivable that the flat artificial grass strips are formed by forming a flat ribbon, attaching to the ribbon artificial grass blades that protrude therefrom on one side, and cutting the ribbon having the protruding artificial grass blades into strips.

In this way also materials may be used that are not suitable to be processed using techniques from the carpeting industry.

The flat ribbon may be extruded, which is a relatively simple and cheap process, while the artificial grass blades may be securely attached to the flat ribbon in simple manner by welding or gluing.

In yet another embodiment of the invention the flat artificial grass strips are formed by supplying a plurality of mutually parallel synthetic fibers, arranging at least one flat strip of a connecting material transversally over the synthetic fibers and connecting it thereto, and cutting the synthetic fibers in the vicinity of one of the edges of the connecting material.

For optimal strength and stiffness it is preferred that strips of connecting material are arranged on both sides of the synthetic fibers and are connected to the synthetic fibers by pressing.

For additional stability it may be desirable that at least some of the flat artificial grass strips are reinforced before being connected together.

When the artificial grass strips are made by weaving, this reinforcing may be achieved in a simple manner by calendering at least some of the relatively dense lengths of cloth.

Alternatively it is also possible to attach at least some of the flat artificial grass strips to a support, while applying a strengthening coating is also one of the possibilities.

The flat artificial grass strips may be connected together by welding, gluing or sewing. Induction welding or ultrasonic welding may be considered as welding techniques. This has the advantage that no other material needs to be added, so that the artificial grass strips may eventually be recycled as a whole. When gluing the use of a hot melt glue is to be preferred since that is simple to process. When the strips are sewn together the yarn that is used is preferably made of the same or a similar material as the artificial grass strips, again with an eye to the eventual recycling.

Finally, the invention relates to an artificial grass product which may be used in a method for laying artificial grass as described in the preamble and which may be produced using the method described above. In accordance with the invention such an artificial grass product comprises a pack of flat and deformable artificial grass strips, each strip comprising a substantially straight lower edge and an upper edge having artificial grass blades protruding therefrom, wherein the strips are arranged with their flat faces in side-by-side relationship and their straight lower edges in substantially the same plane, and are connected to each other at mutually offset locations.

Figure 2:
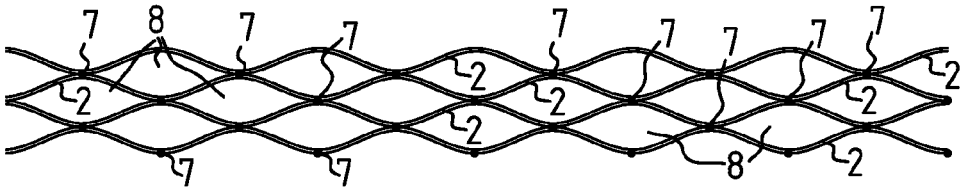
Figure 3:
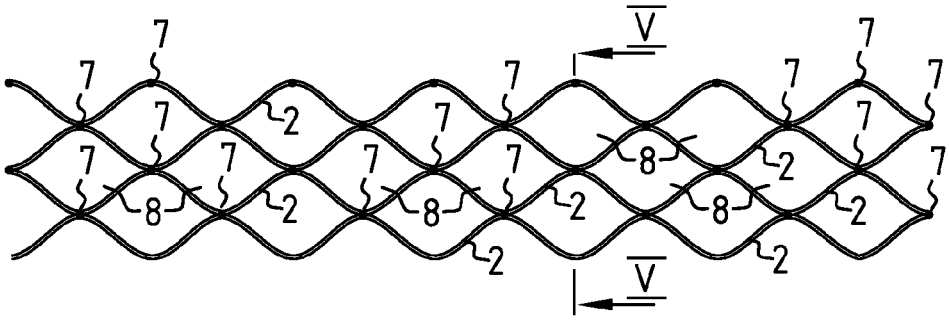
Figure 4:
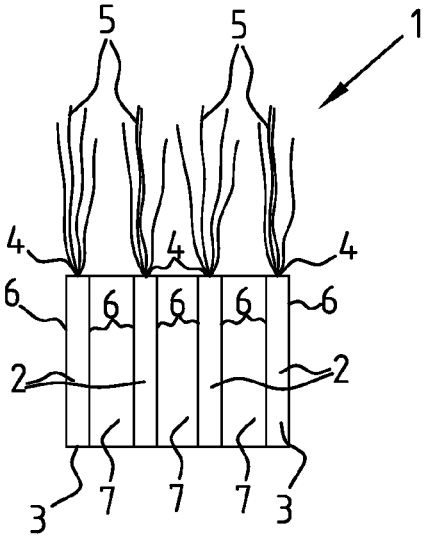
Figure 5:
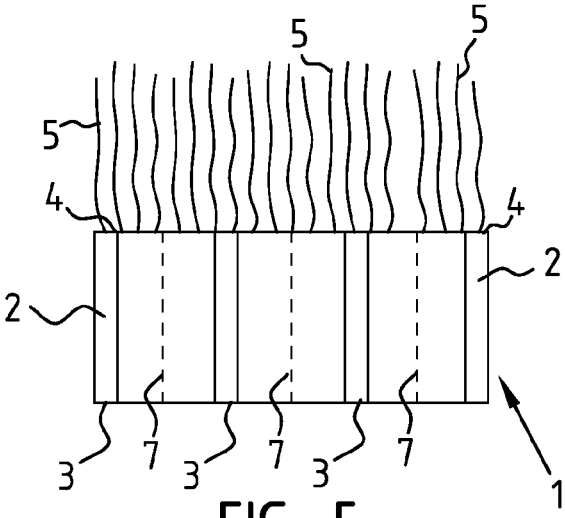
Figure 6:
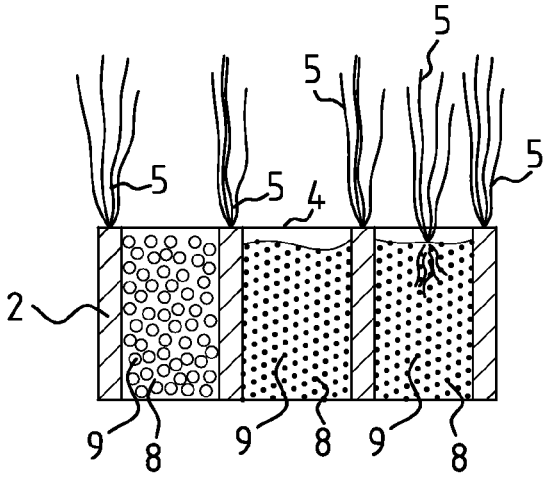
Figure 7:
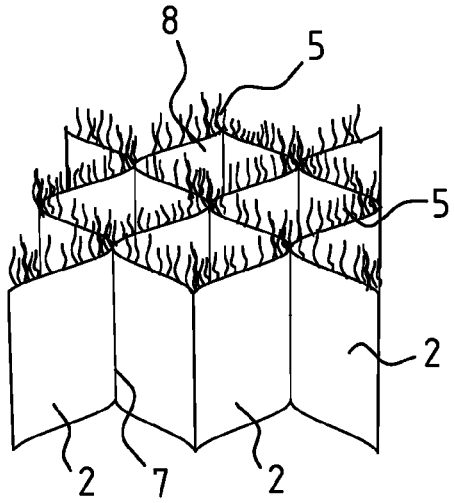
Figure 8:
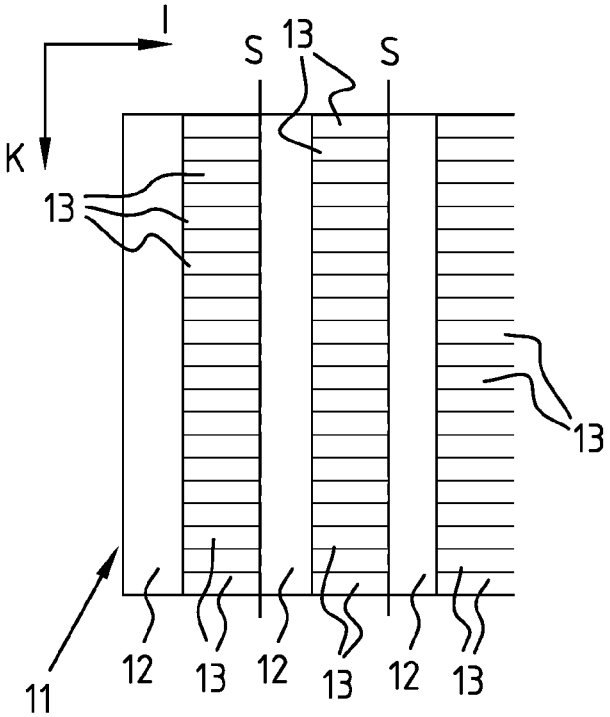
Figure 9:
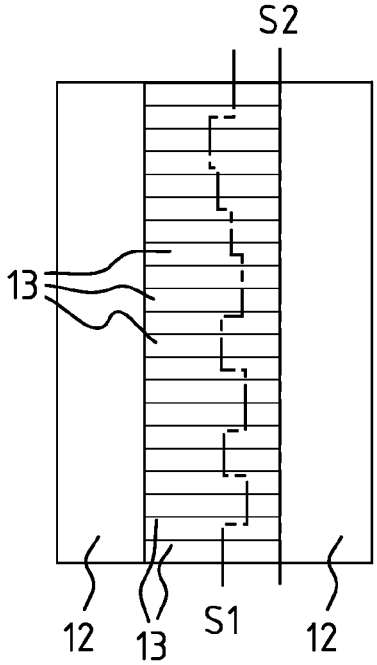
Figure 10:
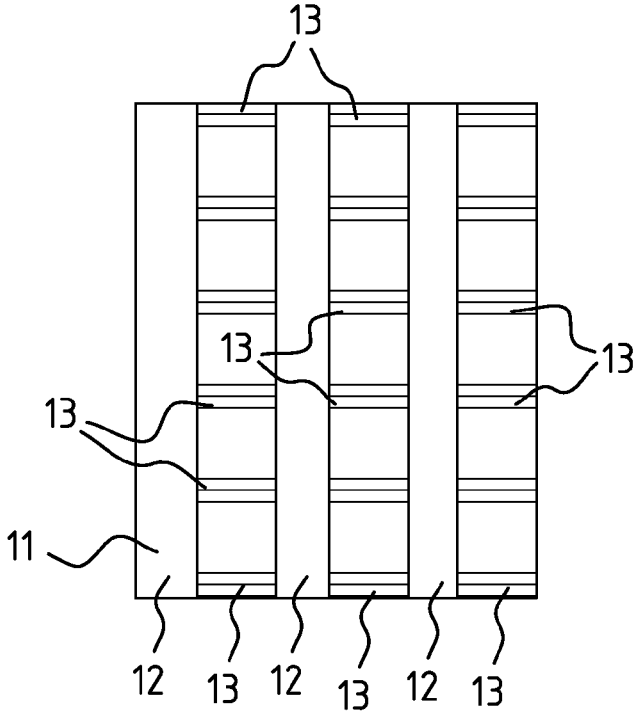
Figure 11:
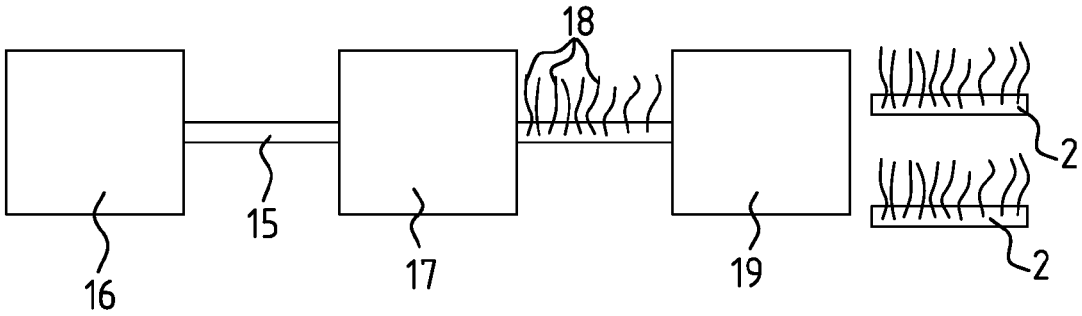

The invention will now be illustrated by means of some examples, with reference being made to the annexed drawing in which:

FIG. 1 is a schematic top view of a pack of artificial grass strips in accordance with the invention, FIG. 2 is a schematic top view of the pack of strips of FIG. 1 in a somewhat drawn apart state, in which a grid is formed having relatively small openings, FIG. 3 is a view corresponding with FIG. 2 of the pack of strips when this is pulled further apart to form a wider grid, FIG. 4 is a cross sectional view through the pack of strips along the line IV-IV in FIG. 1, in which the spacing of the strips is exaggerated, FIG. 5 is a cross sectional view of the pack of strips along the ling V-V in FIG. 3, FIG. 6 is a cross sectional view of the pack of strips in their state when placed and filled, FIG. 7 is a perspective top view of the pack of strips in the drawn apart state of FIG. 3, FIG. 8 schematically shows a flat woven cloth from which a number of artificial grass strips is cut, FIG. 9 shows an alternative cutting scheme for forming artificial grass blades having different lengths, FIG. 10 schematically shows an alternative embodiment of the flat woven cloth in which the synthetic fibers have different spacings for forming wisps of artificial grass, and FIG. 11 schematically shows an extruder and an artificial grass blade fixing station placed downstream thereof.

An artificial grass product 1 according to the invention comprises a pack of flat and deformable artificial grass strips 2. Each artificial grass strip 2 has a substantially straight lower edge 3 and an upper edge 4 from which artificial grass blades 5 protrude. The artificial grass blades 5 may be of any desired type: monofilament blades, fibrillated blades, foamed blades, stretched blades, etc. The strips 2 each have two flat faces 6, which lie next to the flat faces 6 of two adjacent strips 2. The lower edges 3 of all artificial grass strips 2 in the pack lie in one and the same plane. Each strip 2 is connected to the adjacent strips 2 on both sides at mutually offset locations 7.

When the artificial grass product 1 is pulled apart, it forms a grid in which the connection locations 7 form fixed points or vertices. Openings 8 are then defined between the strips 2, which openings can be filled with a stabilizing material 9 when the artificial grass product 1 is placed on or partially in a substrate 10. The stabilizing material 9 may be relatively coarse like chippings or lava, but also relatively fine like sand or earth. Besides the stabilizing material 9 also a resilient and/or damping material like rubber granules may be accommodated in the openings 8, whereby the artificial grass becomes suitable to be played on. The artificial grass strip 2 itself can also be made of a resilient and/or damping material like a plastics foam. The material of the strip 2 does not have to be the same as the material of the artificial grass blades 5, although that does present advantages in view of the eventual recycling. The openings 8 may also be planted or sowed so that for instance natural grass plants or flowers can grow between the artificial grass. The strips 2 could also be made of a biodegradable material so that eventually, after the substrate 10 has been sufficiently stabilized, only the artificial grass blades 5 remain.

The artificial grass strips 2 may be cut from a flat woven cloth 11. Such a cloth 11 may comprise a number of relatively dense lengths of cloth 12 and relatively widely spaced fibers 13 therebetween. By suitably choosing the mutual spacing of the dense length of cloth 12 any desired length of the artificial grass blades 5 may in principle be selected. Spacings in the order of 20 cm may be chosen for use in a goal mouth, so that relatively long artificial grass is obtained.

The dense lengths of cloth 12 may be arranged in the warp direction K and the intermediate fibers 13 in the weft direction I. When all fibers 13 are cut at the same distance from the corresponding dense length of cloth 12, a single cut S will suffice, to be made along the edge 14 of the adjacent dense length of cloth 12 that will form the lower edge 3 of that strip 2. In case the fibers 13 are cut at different lengths (cutting line S1) for a more natural appearance, an additional cut S2 has to be formed along the edge of the next dense length of cloth 12. After cutting the strips 2 must be placed next to each other and connected to each other at offset locations 7, for which welding or gluing apparatus or a sewing machine may be used.

In order to obtain a more natural appearance the fibers 13 may have various spacings. This may be achieved during manufacture of the flat cloth 11 by different spacings between the weft threads, but it is also conceivable that highly shrinking weft threads or biodegradable weft threads are used at some locations.

Instead of a woven cloth 11 the basis for the strips may also be formed by a ribbon of plastics material 15 that is formed by an extruder 16, and onto which separate artificial grass blades 18 are attached in a station 17.

This ribbon 15 may subsequently be cut into strips 2 in a station 19, which strips are then again mutually connected by welding, gluing, sewing or any other means to form the artificial grass product 1.

In yet another embodiment the strips 2 may be formed by supplying a plurality of synthetic fibers running parallel to each other, for instance as warp threads. Subsequently, strips of a connecting material may be arranged over the synthetic fibers with a fixed spacing in the order of some centimetres. This connecting material will extend transversally to the longitudinal direction of the synthetic fibers. Several plastics, various types of geotextiles, foams or fabrics may be considered as connecting material. Preferably, strips of connecting material are arranged on both sides of the synthetic fibers, which strips can then be pressed together to achieve a secure attachment of the synthetic fibers. Here again, artificial grass strips 2 are formed by cutting the synthetic fibers along the edges of the strips of connecting material. These strips can again be assembled to form the artificial grass product 1 by welding, gluing, sewing or other means.

If so desired, the strips 2 may be reinforced before being connected to each other. To this end they can be attached to a support of a similar or different material, for instance a plastic (that may be foamed), another fabric or a non-woven. They could also be coated with a reinforcing layer, while it is also conceivable to reinforce the dense lengths of cloth 12 of the flat fabric by calendering or melting.

Although the invention has been illustrated by means of a number of examples, it will be clear that it is not limited thereto but may be varied in different ways. For instance, the pack of strips could first be pulled apart and only then be arranged on or in the substrate. Moreover, different materials may be used for the strips and the artificial grass blades. Besides plastics like PP and PE, also plastic foams may be used, while moreover also natural fiber materials like flax, coconut fiber and the like can be used. The plastics to be used can comprise both new material and recycled material. Finally, it is conceivable that the grid is reinforced by transverse members, which may be stuck through openings in the strips and may for instance be attached to the substrate by pins.

Consequently, the scope of the invention is solely determined by the following claims.

The invention claimed is:

1. A method for forming an artificial grass layer on a substrate, the method comprising the steps of:

supplying a pack of flat and deformable artificial grass strips, each strip of the strips comprising two flat faces, a substantially straight lower edge and an upper edge having artificial grass blades protruding therefrom, wherein the strips are arranged with their flat faces side-by-side and are connected to each other at mutually offset locations, placing the pack of artificial grass strips on or partially in the substrate, pulling apart the artificial grass strips, thus forming a grid, and at least partially filling at least some of the openings in the grid with a stabilizing material.

2. A method according to claim 1, wherein the stabilizing material is chosen from the group consisting of sand, gravel, earth and lava.

3. A method according to claim 1, wherein at least some of the openings are sowed or planted.

4. A method according to claim 1, wherein at least some of the openings are further filled with a resilient and/or damping material.

5. A method for forming a pack of flat and deformable artificial grass strips, comprising the steps of:

forming a plurality of flat artificial grass strips, each strip of the strips comprising two flat faces, a substantially straight lower edge and an upper edge having artificial grass blades protruding therefrom, placing the artificial grass strips with their flat faces in side-by-side relationship, such that the straight lower edges of the strips lie substantially in the same plane, and connecting adjacent artificial grass strips to each other at mutually offset locations.

6. A method according to claim 5, wherein the flat artificial grass strips are formed by forming a flat woven cloth and cutting the strips therefrom.

7. A method according to claim 6, wherein when forming the flat cloth a plurality of first portions of interwoven warp and weft yarns and a plurality of second portions comprising only weft yarns are formed and wherein the strips are formed by cutting the flat woven cloth into strips along the second portions of the weft yarns.

8. A method according to claim 7, wherein the weft yarns of the second portions are cut at various distances from the first portions.

9. A method according to claim 7, wherein the mutual spacing of the weft yarns of the second portions is varied.

10. A method according to claim 5, wherein the flat artificial grass strips are formed by forming a flat ribbon, attaching to the ribbon artificial grass blades that protrude therefrom on one side, and cutting the ribbon having the protruding artificial grass blades into strips.

11. A method according to claim 10, wherein the flat ribbon is extruded.

12. A method according to claim 10, wherein the artificial grass blades are attached to the flat ribbon by welding or gluing.

13. A method according to claim 5, wherein the flat artificial grass strips are formed by supplying a plurality of mutually parallel synthetic fibers, arranging at least one flat strip of a connecting material transversally over the synthetic fibers and connecting it thereto, and cutting the synthetic fibers in the vicinity of one of the edges of the connecting material.

14. A method according to claim 13, wherein strips of connecting material are arranged on both sides of the synthetic fibers and are connected to the synthetic fibers by pressing.

15. A method according to claim 5, wherein at least some of the flat artificial grass strips are reinforced before being connected together.

16. A method according to claim 7, wherein at least some of the first portions of the flat cloth are calendered.

17. A method according to claim 16, wherein at least some of the flat artificial grass strips are attached to a support.

18. A method according to claim 5, wherein the flat artificial grass strips are connected to each other by welding, gluing or sewing.

19. An artificial grass product, the artificial grass product comprising:

a pack of flat and deformable artificial grass strips, each strip of the strips comprising two flat faces, a substantially straight lower edge and an upper edge having artificial grass blades protruding therefrom, wherein the strips are arranged with their flat faces in side-by-side relationship and their straight lower edges in substantially the same plane, and are connected to each other at mutually offset locations.

20. An artificial grass product according to claim 19, wherein each flat artificial grass strip comprises:

a first portion and a second portion of a flat woven cloth;

wherein the first portion comprises interwoven warp and weft yarns, the first portion having the substantially straight lower edge and the upper edge; and wherein the second portion comprises only weft yarns which form the protruding artificial grass blades.

21. An artificial grass product according to claim 20, wherein the first portion is reinforced.

22. An artificial grass product according to claim 19, wherein each flat artificial grass strip comprises a ribbon of plastics material and a plurality of artificial grass blades attached thereto and protruding from one side.

23. An artificial grass product according to claim 22, wherein the plastics material is a foam.

24. An artificial grass product according to claim 19, wherein the flat artificial grass strips are connected to each other by welding, gluing or sewing.

25. An artificial grass product according to claim 19, wherein the flat artificial grass strips are at least partially manufactured from a biodegradable material.

* * * * *